United States Patent [19]

McMakin et al.

[11] Patent Number: 4,911,266

[45] Date of Patent: Mar. 27, 1990

[54] LADDER LIFT APPARATUS

[75] Inventors: William H. McMakin; Mark R. McMakin; Glen R. McMakin, all of Silver Spring, Md.

[73] Assignee: McCrane Co., New Castle, Del.

[21] Appl. No.: 242,597

[22] Filed: Sep. 9, 1988

Related U.S. Application Data

[63] Continuation-in-part of Ser. No. 129,069, Dec. 7, 1987, Pat. No. 4,770,273.

[51] Int. Cl.[4] ..... E06C 7/12

[52] U.S. Cl. ..... 182/129; 182/102; 182/145; 187/2; 187/11

[58] Field of Search ..... 182/63, 102, 129, 93, 182/142, 172; 187/2, 9 R, 10, 11

[56] References Cited

U.S. PATENT DOCUMENTS

| | | | |
|---|---|---|---|
| 71,139 | 11/1867 | Crawford | 182/145 |
| 235,255 | 12/1880 | King | 182/145 |
| 715,747 | 12/1902 | Bock | 182/129 |
| 921,431 | 5/1909 | Miller | 182/145 |
| 4,770,273 | 9/1988 | McMakin | 182/129 |

*Primary Examiner*—Reinaldo P. Machado
*Attorney, Agent, or Firm*—John C. LaPrade

[57] ABSTRACT

An improved ladder lifting apparatus usable to lift heavy loads from the ground to a roof surface including a horizontally positioned, hand or shoulder mounted lifting bar or beam with a winch means, fastened to the bar or beam where one end of the lifting bar or beam is fastened and/or connected to the side rails of a vertically positioned ladder or extension ladder, with means to allow movement of the upper end of the ladder toward the roof to deposit the load on the roof or into a window of a multi-story building combined with optional stabilizing features for the ladder to make use of the lift bar at high elevations more safe.

29 Claims, 2 Drawing Sheets

LADDER LIFT APPARATUS

The invention described and defined in this application is an improvement of the invention disclosed and claimed in application Ser. No. 129,069 filed 12/7/87. This application is a continuation in part of application Ser. No. 129,069 filed 12/7/87 issued as U.S. Pat. No. 4,770,273.

BACKGROUND OF THE INVENTION

The present invention relates to an improved lifting apparatus and tool for use by air condition contractors, carpenters, electricians, painters, and roofers who need to move materials to the second, third, and fourth stories or roofs of buildings being constructed or remodeled.

Various lift devices, utilizing hand operated winches or windlasses are known in the art. Typical of those found in the art are illustrated in U.S. Pat. Nos. 2,426,825, 4,232,759, and 4,458,764. In particular U.S. Pat. Nos. 599,169; 4,598,795; and 4,690,248 Alber 2,118,585; Book 3,074,508; Cox 3,902,700; Wilson 3,964,573; Ziegelmann 4,128,228; Killen 4,690,248; disclose ladder bracket and ladder lifts of various types.

The present invention comprises a novel means for attachment of applicants' lift bar comprising a one piece, light weight shoulder mounted, hand held apparatus to be affixed, temporarily or permanently to the two side rails of an industrial ladder to allow the operator to move a piece of equipment or a materials container onto the roof of a multistory building that is usually from 2 to 4 stories high or higher.

The improvements to the invention, as described in this application, illustrate alternative means to fasten the lift bar to the side rails of the ladder and optional means to stabilize the base of the ladder to reduce the risk of sidewise tipping, when heavily loaded at high elevations.

SUMMARY OF THE INVENTION

Accordingly, it is the primary object of the present invention to provide a lifting apparatus which avoids the disadvantages of the prior art.

It is another object of the present invention to provide a ladder lift apparatus which requires little set up time by one man and is sturdy and inexpensive to manufacture and has a total weight of 20 to 40 pounds.

It is still one additional object of the present invention to provide a lifting apparatus and tool that combines a vertically positioned extension ladder with a horizontally positioned lifting bar equipped with winch and cable means to allow an operator standing on the roof to move a heavy load from the ground onto the roof.

It is one further object of the present invention to provide bracket means to attach the lift bar apparatus of this invention to the two side rails of a ladder or extension ladder. A pivot member may be provided, but is not required, to facilitate connection of the lift bar to the bracket means. Such a pivot member readily allows the load to be pulled onto the edge of the roof after the load is suspended at its maximum vertical position, to allow the load to be deposited on the roof or into an open, upper story window.

It is also one additional object of the invention to provide a horizontally positioned lifting bar apparatus with a padded shoulder mount and handle member that allows one end of the lifting bar to be supported by the hand and/or the shoulder of the operator while standing on the roof or on an upper floor of a building and the other end of the lifting bar is supported by the side rails of the ladder.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of one embodiment of the invention illustrating the lift bar in use on top of a building.

FIG. **5*a*** is a plan view, partly in cross section, of an alternative embodiment of a lateral stabilizer.

FIG. **5*b*** is a plan view of an alternative embodiment of the lateral stabilizer of the instant invention.

Figure 6:
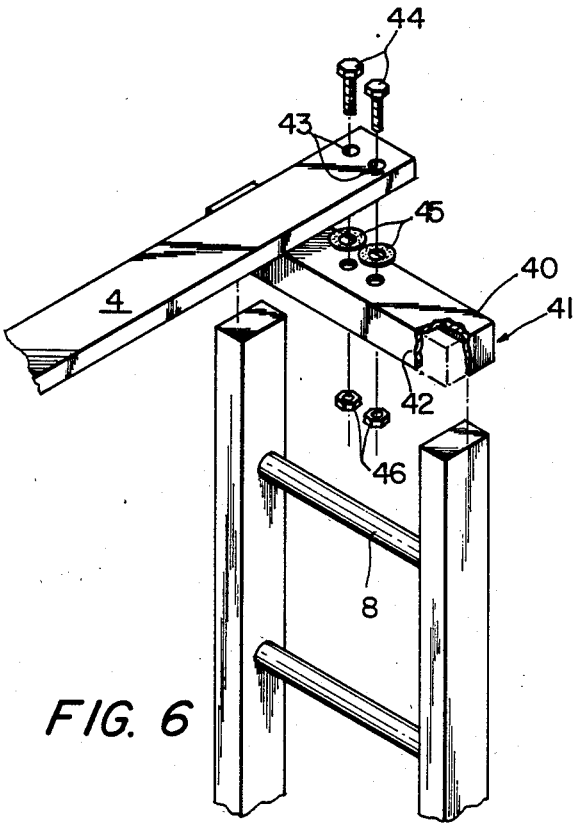

FIG. 6 is a perspective view, partly cut away of another embodiment of the invention with means to connect the lift bar to the end cap bracket.

Figure 7:
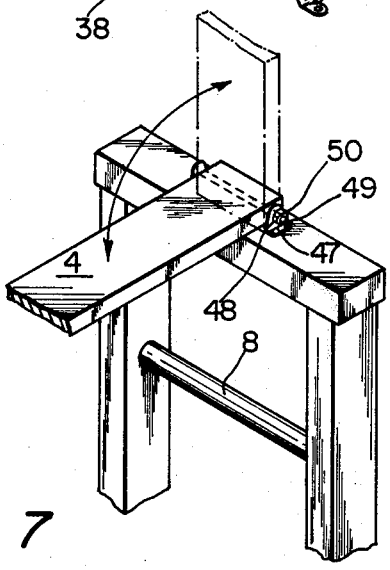

FIG. 7 is a perspective view of another embodiment of the invention where the lift bar is pivotally attached to the end cap bracket.

DESCRIPTION OF THE PREFERRED EMBODIMENT

In FIG. 1, that is a perspective view, a building 1, with a flat roof 2 supports an operator 3. The operator 3 standing on the roof operates lifting bar 4 by placing one end of the bar with shoulder support 5 on the operator's shoulder. The lift bar 4 is supported and attached by a connection on its other end to a ladder or equivalent support member that stands on the ground 6. The ladder 7 may be a conventional industrial grade heavy duty ladder, metal, wood or fiberglass. If an extension ladder 7, is used, it should be an industrially rated ladder, marked to indicate its ability to safely support at least 250 or 300 lbs. The ladder with side rails 7 has rungs 8. The lift bar 4 is attached to and supported by a bracket or plate 17.

A conventional winch or windlass assembly, 10 may be mounted by bolting or by welding the winch 10 to the upper face or the lower face of lifting bar 4. FIG. 1 shows the winch 10 mounted on the lower face of bar 4.

The winch or windlass assembly 10 in FIG. 1, may consist of a conventional winch or windlass, ratchet and pawl. Such a winch assembly may have a ratchet gear ratio of about 1 to 4 to 1 to 17 or more to allow the winch to be turned more easily by the operator.

Figure 3:
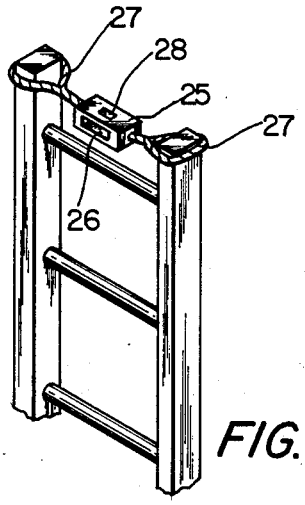
FIG. 3 is a perspective view of another embodiment of the invention illustrating means of connecting, the lift bar to the ladder.

The winch or windlass 10 has a drum on which 30 to 40 ft. or more of cable is stored and is fed out, when in use. Cable 12 may be fed out through a cable guide means 13. The cable 12 may be used with a pulley 14 having a hook 16A on its lower end. In such arrangement, as shown in FIG. 3, the end of cable 12 is fitted with a hook 16 that is secured in cable guide means 15. In this arrangement, the weight of the load is evenly divided between the two guide means 13 and 15. In such a configuration the operator will find it much easier to turn the crank handle 11 of the windlass or winch 10.

As stated in applicants' co-pending application, Ser. No. 129,069, the lift bar tool illustrated in FIG. 1 is designed to have one end of the lift bar 4 rest on the operators shoulder in order to speed up the operation of lifting and to make it more efficient. In some cases, where the load is over 300 lbs. and particularly in the range of 400 lbs. to 500 lbs. an alternative support means may be used to support the lift bar 4. The lift bar may be supported by a pivotal post or tripod and telescopic leg that may be rotated into position. A tripod 17*a* may be used to support one end of bar 4 as shown in the co-pending application Ser. No. 129,069 filed Dec. 7, 1987.

In FIG. 1 the end of the lift bar 4 is fitted over top of an end plate or end bracket 17 so that the bar 4 is evenly supported by the upper ends 9 and 9A of the two side rails of the ladder. In FIG. 1 a vertical bolt 19 may be used to connect the lift bar to the end bracket 17. Other structually equivalent brackets and support means may be used to support the lift bar evenly and uniformly by and between the two upstanding side rails 9 and 9A of the ladder.

Figure 4:
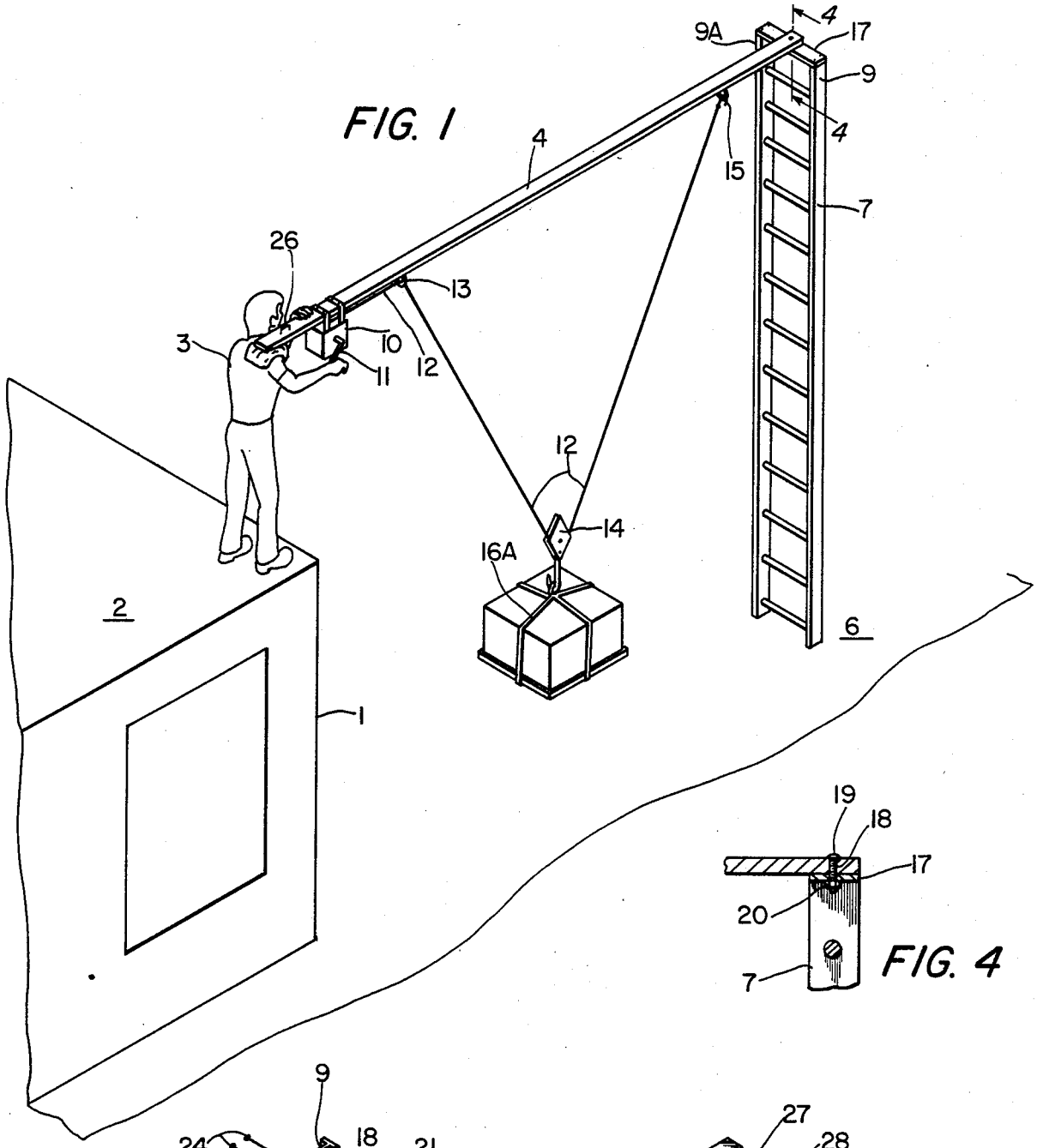
FIG. 4 is a partly cut away plan view of the lift bar attached to the bracket means that is separated from the ladder.

The end bracket 17 that fits over the upstanding ends of side rails 9 and 9A may be made of an aluminum alloy (6061 or 6063), reinforced fiberglass or other suitable material. The thickness will usually vary from about ⅛ inch to ½ inch and in all cases be of adequate strength to support a total load of 400 to 500 pounds. The lift bar 4 may have an opening 18 near the end thereof that is aligned with hole 18 in the end bracket 17. A pin or bolt 19 extends thru bracket 17 to connect bracket 17 to lift bar 4. The bracket 17 may be fastened to the upper ends of side rails 9 and 9A by screws or other suitable connectors (not shown) that physically attach the bracket to the side rails at 9 and 9A. This connection is best shown in FIG. 4.

Figure 2:
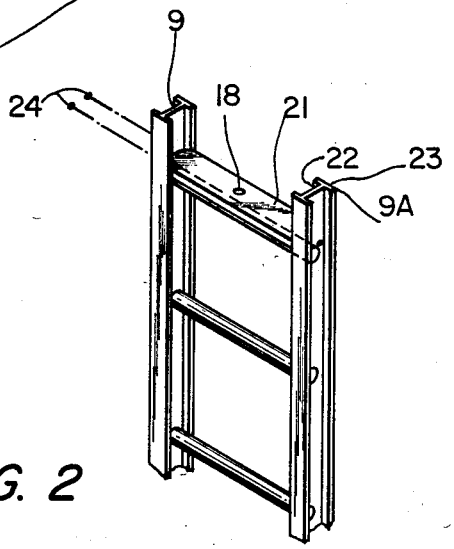
FIG. 2 is a perspective view of a modified embodiment of the invention illustrating another means of connecting the lift bar to the ladder.

In FIG. 2 a solid support element 21 may be positioned above the top rung 8 and support the lift bar 4 by a pin or bolt. The flat step bracket that is a solid support 21 may be screwed or bolted to the I beam structure 22 and 23 as shown in FIG. 2 so as to form a horizontal support means 21 for the lift bar. In this structure the solid support element 21 supports the lift bar 4 and evenly distributes the load to each upper end 9 and 9A of the side rails of the ladder, as best shown in FIG. 2.

In FIG. 3 a collar member 25 is supported by a braided nylon rope 27. The braid may be made of any strong fiberous or metallic material that can support a total load of 400 to 500 pounds. In this embodiment the load on lift bar 4 is supported by the collar 25 having an opening 26 that is suspended by the two braided supports 27 that encircle upper ends 9 and 9A of the side rails. A pin or bolt may be inserted in opening 28 to may secure the collar 25 to the lift bar 4. The collar 25 may be made of a rectangular tubular metal about ⅛ to ¼ inch thick, with a length of 4 inches to 5 inches and capable of supporting a load of 400 to 500 pounds.

Figure 5A:
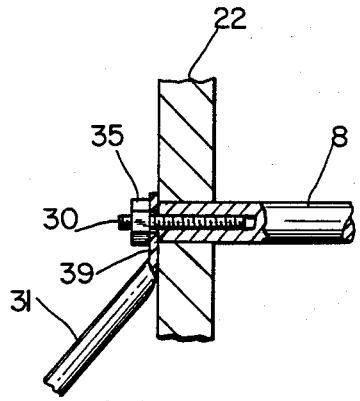
FIG. 5 is a perspective view, illustrating a stabilizer means to minimize lateral tipping of the ladder.
Figure 5B:
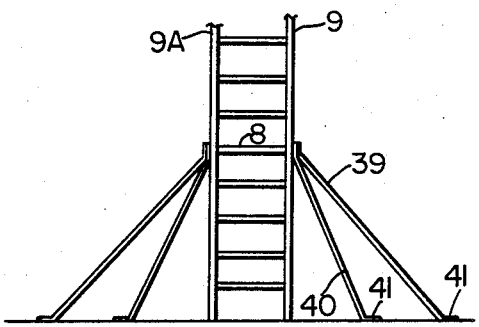
Figure 5:
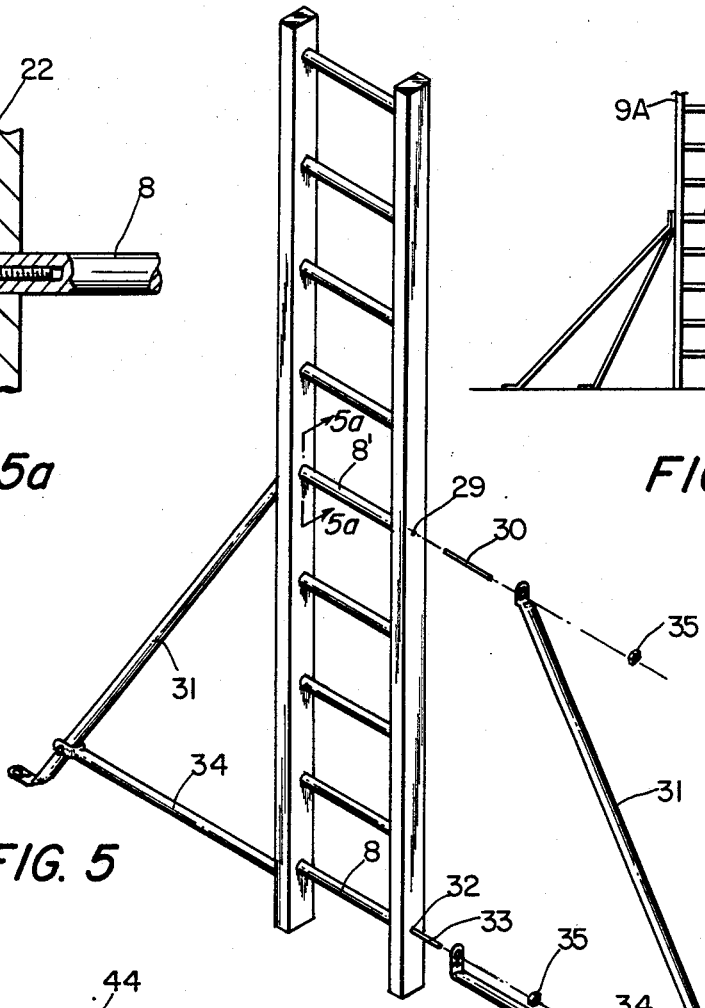

In FIG. 5 a triangular shaped lateral reinforcing brace or lateral stabilizer consists of member 31 that is secured at its upper position by a bolt 30 with screw threads on at least one end as shown in FIG. 5*a*. The bolts 30 and 33 may be positioned thru hole 29 and hole 32 without any loss of any strength of the ladder. In this embodiment the bolts 30 and 33 are positioned thru the inside of tubular rungs 8 and 8' where tubular members 31 and 34 are pinned together by pin 38 at the outer end of the lower member 34 forming a rigid triangular reinforcing brace or lateral stabilizer. Thus a triangular brace or stabilizer may secured and bolted on each side of the ladder. The use of thes two lateral stabilizers, that form triangles on each side of the ladder, steady the ladder on high lifts of 20 feet to 40 feet high. The elements 31 and 34 may be made of tubular metal that may vary from about ¾ inch to 1½ inches in diameter, with a wall thickness of about ⅛ inch to ¼ inch, if contracted of aluminum or aluminum alloy.

In FIG. 5*a*, that is a partly cut away view, bolt 30 is shown as threaded on its outer ends to receive nut 35. This bolt 30 runs thru the entire length of rung 8 and projects beyond the side rails 7 of the ladder. Elements 31 and 34 may also be constructed of flat metal, preferably ¾ to 1½ inches wide and about ⅛ to ¼ inch thick. Such a flat metal element may be made of aluminum alloyed with steel and/or magnesium. Aluminum alloys 6061 or 6063, that are well known to be high strength and light weight, are particularly useful in this embodiment. The flatened portions 39 at the end of rods 31 and the inner end of rod 34 give a firm, secure contact with the ground and with the ladder rail at rod 33 and tend to stabilize and brace the ladder against sidewise movement.

The outer ends 36 of tubular elements 34 may be partly cut away or scalloped to form opening 37 so as to facilitate joining members 31 and 34 by a pin or bolt 38 or other suitable connector.

In FIG. 5*a* flat portion 39 is bolted to I beam midsection 22 by a threaded bolt 30.

In FIG. 5*b* a pair of rods 39 and 40 each being free on the lower ends 41 can be positioned to the side of the ladder to stabilize the ladder. In this embodiment, the length of each rod 39 and 40 is longer than the ladder from the point bolt 30 fastens the tab 39 to the side rail of the ladder and therefore stabilized the ladder against lateral movement, and from side to side as a heavy load is raised to a height of 20 to 40 feet.

In FIG. 6 an end cap bracket 40 fits over both upper ends of the side rails and supports lift bar 4. The side wall 41 of the end cap bracket 40 will usually vary from about 2 inches to 6 inches in height. The thickness of the end cap bracket 40 at the side wall indicated at 42 and on its top load bearing surface may vary from about ⅛ inch to ¼ inch and may be made of a high strength aluminum alloy such as alloy 6061 or all 6063. In this embodiment end cap 40 is permanently fastened to lift bar 4 by a pair of bolts 44 that extend thru openings 43. A pair of rubber or plastic resilient washers 45 may be used to allow the lift bar 4 to pivot slightly, usually from 2 degrees to 10 degrees when under load. Bolts 44 may be fastened by nuts 46 to securely fasten lift bar 4.

In FIG. 7 end cap bracket 40 may be fastened by a pivot mechanism and means to lift bar 4. The pivot mechanism is a pair of upstanding brackets 47 with openings 48 thru each bracket 47. A threaded rod or bolt 49 extends thru each bracket 47 and supports lift bar 4, in a manner to allow lift bar to pivot above end cap bracket 40. In this embodiment the end cap bracket 40 may be permanently fastened to the upper ends 9 and 9A of both side rails of the ladder. When the lift bar is to be attached for use in lifting a load threaded bolt 49 is extended thru opening 48 and nuts 50 are screwed onto each ends of bolt 49.

A stabilizer means 36 shown in FIG. 1*a*, in co-pending application Ser. No. 129,069 may be used to assure the safe delivery of the load and the stable vertical position of the ladder 7 during the lifting operation by securing the ladder in a vertical position and parallel to the building 2.

A cable or rope may likewise be used to secure the bottom of the ladder to the building to prevent the ladders movement away from the building while the load is deposited on the roof.

METHOD OF OPERATION

In the method of operating the lift bar of the instant invention the following steps should be followed, in sequence:

(1) The ladder 7, (one piece ladder or extension ladder) should be extended up beside the building so that the upper end of the side rails are above the lowest roof level.

(2) The operator takes the lift bar on his shoulder and climbs to the top of the building and places the lift bar 4 on the roof.

(3) Bolt or clamp the lift bar to the bracket affixed across the two upper ends of the side rails of the ladder. In the alternative the end cap bracket may be bolted to the lift bar 4 and then merely slipped over the two upstanding ends of the side rails as shown in FIG. 7 of this application.

(4) While holding the shoulder-mounted end of the lift bar the operator pushes the top of the ladder out from the building until the ladder is parallel to the building. The ladder should never be set up more than 46 to 48 inches from the building. Optionally a stabilizer means may be attached to the ladder to secure it in a vertical, parallel position, as set forth above.

(5) Optionally attach a flange and safety rope or cable to secure the bottom of the ladder to the building so that the ladder will not kick out during transfer of the load to the building.

(6) The operator then places shoulder mount 5 on his shoulder.

(7) The load is attached to the lower end of the cable and the operator starts the winch to place tension on the cable.

(8) The operation of the winch lifts the load to the general level of the top rung of the ladder and above the roof level.

(9) When the load is in a proper position the operator moves back and pulls the handle and lift bar towards him and away from the edge of the roof so that the load will be pivoted to move onto the roof. The ladder pivots at the ground level and the top of the ladder moves to the edge of the roof.

(10) The load is then deposited on the roof or into an open window in the same manner.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

We claim:

1. A lift apparatus for use to lift a heavy load from the ground to the roof of a building comprising in combination:

(a) a vertically positioned heavy duty ladder with two side rails and multiple rungs, wherein the two side rails are fitted with means to engage and support a lift bar member.

(b) a horizontally positioned lift bar member, with lifting means attached to the lift bar member.

(c) attachment means positioned on one end of the lift bar to attach the lift bar to the side rails of the ladder so that the weight of the load on the lift bar is directly transferred to the side rails of the ladder.

(d) means to move the upper end of the ladder to the edge of the roof to allow delivery of the load onto the roof.

2. The lift apparatus of claim 1, where in the two side rails are fitted with an end cap bracket that supports the lift bar.

3. The lift apparatus of claim 1, where in the ladder is an extension ladder.

4. The lifting apparatus defined in claim 1, wherein the horizontal lift bar member is a straight, light weight tubular member of sufficient strength to avoid bending under a load of 500 lb.

5. The lift apparatus as defined in claim 1 where the means to pivotally attach the lift bar to the bracket is a bolt.

6. The apparatus of claim 1 where the end cap bracket is a single piece that evenly distributes the weight of the load on each side rail.

7. The apparatus of claim 1 where the end cap bracket is secured to the upper end of each side rail of the ladder by screws.

8. The lift bar apparatus defined in claim 1. Wherein, the means to attach the lift bar member to the end cap bracket is a collar means that fits around the lift bar.

9. The lift apparatus of claim 1 wherein the means to lift the load is a winch assembly, comprising a drum, ratchet gear, pawl and crank handle that operates the ratchet gear, cable, pulley, and hook positioned on a lift bar, the said lift bar being attached to the side rails of the ladder by a bracket.

10. The lift apparatus defined in claim 2 wherein the means to move the upper end of the ladder is a handle member extending from the lift bar.

11. The lift apparatus as defined in claim 1 where the operator shoulder support means is supplemented by a mobile platform member.

12. The lift apparatus as defined in claim 11 where the operator shoulder support means includes a handle.

13. The lift apparatus as defined in claim 11 where the platform member is a tripod.

14. In a ladder lift system including vertical structure comprising a conventional extension ladder mounted in a vertical position adjacent to and generally parallel to the side wall of a building and horizontal structure attached to a vertically positioned ladder; the improvement comprising as a part of the horizontal structure, a horizontally positioned lift bar, means to fasten one end of the lift bar to the upright siderails of the vertically extended ladder, and where one surface of the lift bar is fitted with a lift means including a cable and at least one cable guide means and when the lift means is manually operated by an operator who supports one end of the lift bar.

15. The ladder lift system defined in claim 14 where the winch lift means comprises a winch, associated cable and at least one cable guide means.

16. The ladder lift system defined in claim 14, where the means to fasten one end of lift bar to the ladder is a laterally disposed bracket member permanently fastened to the lift bar and where the bracket member is fitted with means to fasten the lift bar to each of the upstanding siderails of the ladder.

17. The ladder lift system defined in claim 14 where the lift means is an electrically driven winch that the operator initiates while supporting one end of the lift bar.

18. The ladder lift system defined in claim 14 where the winch is hand operated by an operator who turns the crank arm while supporting one end of the lift bar.

19. The ladder lift system defined in claim 14 where a flat wedge bracket means supports the lift bar above one of the rungs of the ladder.

20. The ladder lift system defined in claim 19 where the flat step bracket is supported by means positioned below the wedge bracket to fasten the bracket to the side rails of the ladder.

21. The ladder lift system defined in claim 20 where the means to fasten the bracket to the ladder is a plurality of screws.

22. The ladder lift system of claim 12 wherein a triangular stabilizer is used to secure the ladder in a vertical position, essentially parallel to the building.

23. The lift apparatus of claim 1 where a lateral stabilizer means is bolted to one siderail of the ladder by a bolt that extends thru one rung of the ladder, from one end of the rung to the other.

24. The lift apparatus of claim 23 where the lateral stabilizer means comprises a triangular stabilizer bolted to one side rail of the ladder.

25. The lift apparatus of claim 14 where a lateral stabilizer means comprises a rod with its upper end bolted to the side rail of the ladder and where the lower end of the rod is in contact with the ground.

26. The lift apparatus of claim 25 where the lower end of the rod extends beyond the lower end of the ladder.

27. The lift apparatus of claim 1 where the lift bar is supported by a collar means that is affixed to each upper end of the side rails of the ladder by a braided rope support extending to each upper side rail of the ladder.

28. The lift apparatus of claim 14 where the lift bar is supported by a collar means that is attached to each upper end of the side rails of the ladder.

29. The lift apparatus of claim 25 where the lateral stabilizer means comprises a angular support member bolted at its upper end to the side rail of the ladder and its lower end in contact with the ground and a connecting rod affixed parallel to the ground.

* * * * *